US005165488A

United States Patent [19]

Liu

[11] Patent Number: 5,165,488

[45] Date of Patent: Nov. 24, 1992

[54] ELECTRIC VIBRATOR TOOL

[76] Inventor: Chen-Hai Liu, 6F-11, No. 289, Lin Shen Road, Taipei, Taiwan

[21] Appl. No.: 871,015

[22] Filed: Apr. 20, 1992

[51] Int. Cl.[5] ..... B43K 5/00

[52] U.S. Cl. ..... 173/49; 173/117; 81/9.22; 30/277.4

[58] Field of Search ..... 173/49, 117; 81/9.22; 30/164.9, 277.4

[56] References Cited

U.S. PATENT DOCUMENTS

| | | | |
|---|---|---|---|
| 3,337,954 | 8/1967 | Robison | 30/277.4 |
| 3,357,102 | 12/1967 | Horshak | 30/277.4 |
| 4,204,438 | 5/1980 | Binaris et al. | 81/9.22 |
| 4,711,030 | 12/1987 | Ruston, Sr. | 30/277.4 |
| 4,782,725 | 11/1988 | Spaulding | 81/9.22 |
| 4,796,624 | 1/1989 | Trott et al. | 81/9.22 |
| 4,914,988 | 4/1990 | Chang | 81/9.22 |

*Primary Examiner*—Douglas D. Watts

*Assistant Examiner*—Scott A. Smith

*Attorney, Agent, or Firm*—Bacon & Thomas

[57] ABSTRACT

An improved electric vibrator tool which is equipped with a driving mechanism housed in the handle case thereof and having an eccentric disc which actuates a driving rod to perform reciprocating operations; a clamping element is attached to the end of the driving rod to receive a tool bit which is reciprocally operated, such as, a tatooing needle, a carving knife and the like; at the end of the handle case is removably attached with a power box in which are disposed non-rechargeable or chargeable batteries and a plug for charging purpose is disposed at the end of the case; or an adaptor is attached instead of battery box to the handle case so that the present vibrator tool can be operated by A.C. power source. A switch concealed inside the tool is actuated by way of rotation so as to make the operation of the tool safer.

3 Claims, 7 Drawing Sheets

ELECTRIC VIBRATOR TOOL

BACKGROUND OF THE INVENTION

The present invention is related to an improved electric vibrator tool which is equipped with an eccentric disc so as to make the same reciprocally operated; and the present vibrator tool can be powered by common batteries or by rechargeable ones or by A.C. power source via an adaptor and a concealed switch is actuated by way of rotation of the front end of the tool, preventing the switch from being accidently actuated.

Portable electric tools have been widely used for the past because the advancement of the technology in the battery industry and the availabilty of cheap and efficient rechargeable batteries, and electric adaptors for various purpose can also be easily obtained in the shops. There are a number of vibrator tools based on the reciprocating operation of an eccentric disc popularly adopted by people in the carving and tatooing business. The conventional electric vibrator tools still have some inherent problems which are given as below:

1. The power supply depends on either the batteries or an A.C. source transformed via an adaptor that are generally not compatible; when batteries run out or become weak and no other power source is available, the operation of the tools becomes impossible and causes great inconveinence.

2. The control buttons of the conventional tools are either operated by pressing or by pushing via a finger, this type of buttons are easily accidently actuated, resulting in the sudden stop or start of the tools.

The present inventor has noticed the disadvantages of the prior art and works out an improved electric vibrator tool which is free from the above problems and can be operated in a safer and more convenient manner.

SUMMARY OF THE INVENTION

The primary object of the present invention is to provide an improved electric vibrator tool which is able to be operated by way of common batteries or by rechargeable batteries or by an A.C. power source transformed via an adaptor so that the present vibrator tool can be used in a more convenient manner.

Another object of the present invention is to provide an improved electric vibrator tool which is provided with a concealed switch inside thereof which is operated by rotation so as to make the actuation of the tool safer.

BRIEF DESCRIPTION OF THE DRAWINGS

To better illustrate the features, operational modes and structure of the present invention, a number of drawings are given in company with a detailed description of a preferred embodiment of the present invention, in which.

DETAILED DESCRIPTION OF THE PREFERRED EMBODIMENT

Figure 1:
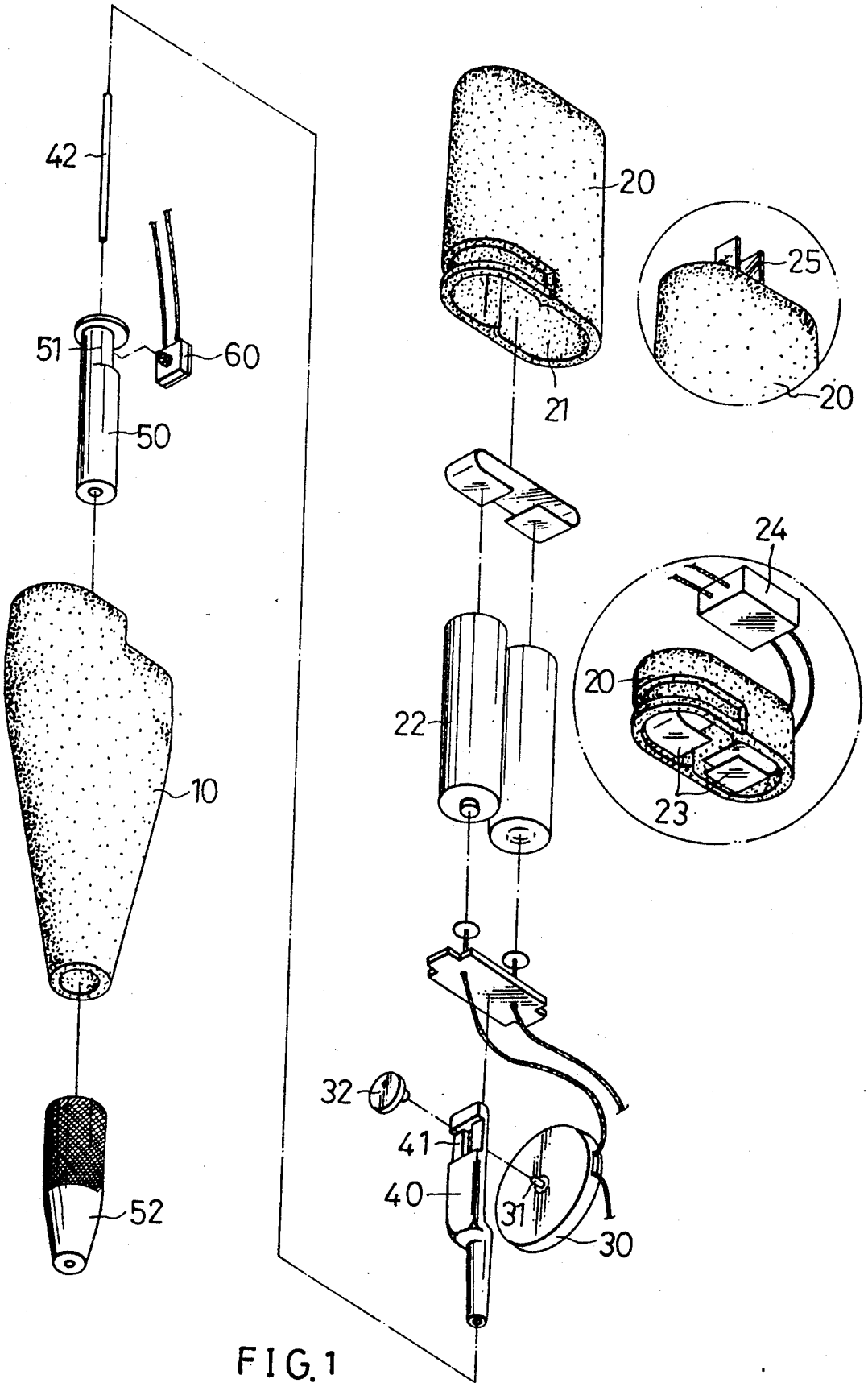
FIG. 1 is a pespective view of the exploded components of the present invention.
Figure 2:
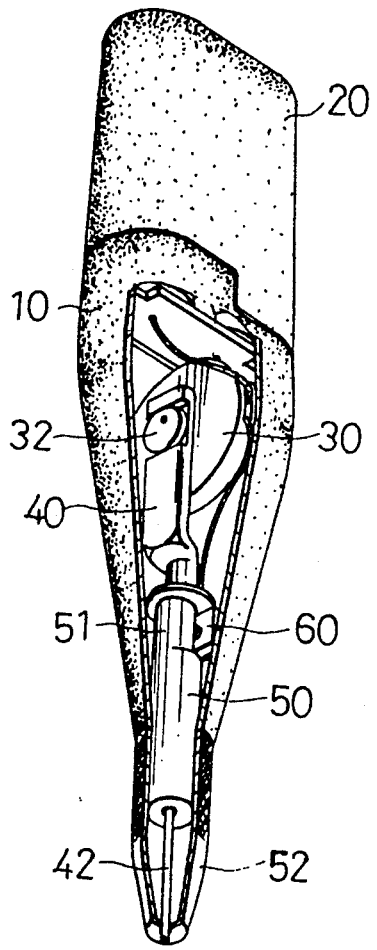
FIG. 2 is a partially sectional view of the driving mechanism of the present invention.
Figure 6:
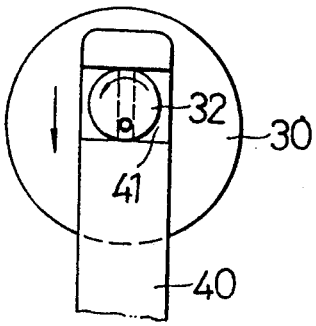
FIGS. 6A–D show the continuous steps of the operation of the eccentric disc of the driving means thereof.
Figure 6:
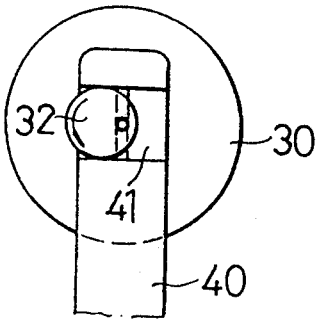
Figure 6:
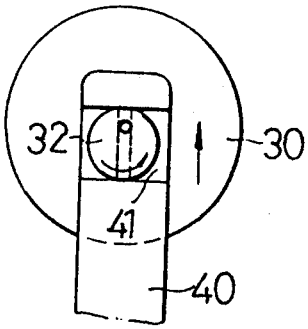
Figure 6:
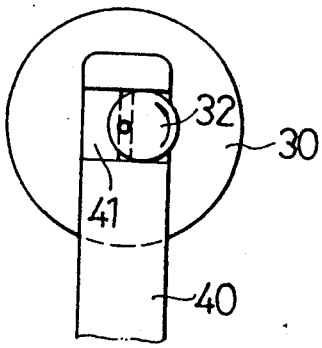

Referring to FIGS. 1, 2, the present vibrator tool includes a handle case 10, a power box 20, and a driving means 30, a driving rod 40, an inner sleeve 50 and a switch 60. The driving means 30 is disposed inside the handle case 10 with the driving shaft 31 thereof passing through a slot 41 disposed at the bottom end of the driving rod 40 and engaged with an eccentric disc 32. The diameter of the eccentric disc 32 is the same as that of the length of a recess in which the slot 41 is defined so that the disc 32 can rotationally operate within the recess and drive the driving rod to reciprocally move up and down in a linear manner as shown in FIG. 6 to produce a vibration effect. The other end of the driving rod 40 is removably attached with a clamping means 42 which is led through the inner sleeve 50 with a tatooing needle or a carving knife or the like instrument operating in a reciprocating manner secured thereto. An inner sleeve 50 is disposed at the front end of the handle case with part thereof protruding from the opening of the case 10. An outer sleeve 52 is securedly jointed to the protruding end of the inner sleeve 50 with the end thereof in abutment with the frontmost edge of the handle case 10.

Figure 7:
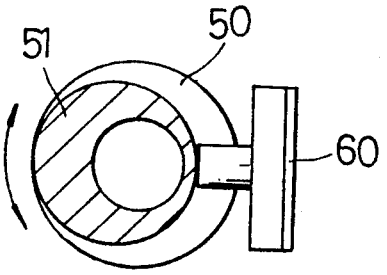
FIGS. 7A–B show the actuation of the switch of the present invention by rotation.
Figure 7:
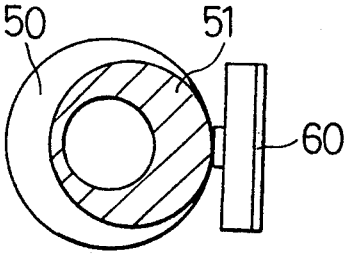

The inner sleeve 50 terminates with a horizontally disposed eccentric disc 51 which is located in contact with a switch 60 as shown in FIG. 7. When the switch is not pressed by the eccentric disc as shown in FIG. 7A, the switch 60 is not turned on; and when the switch 60 is pressed down as a result of the rotation of the outer sleeve 52 180 degrees in either direction, ending up with the eccentric disc 51 in pressing contact with the switch 60, as shown in FIG. 7B, and the switch 60 is then turned off.

Figure 3:
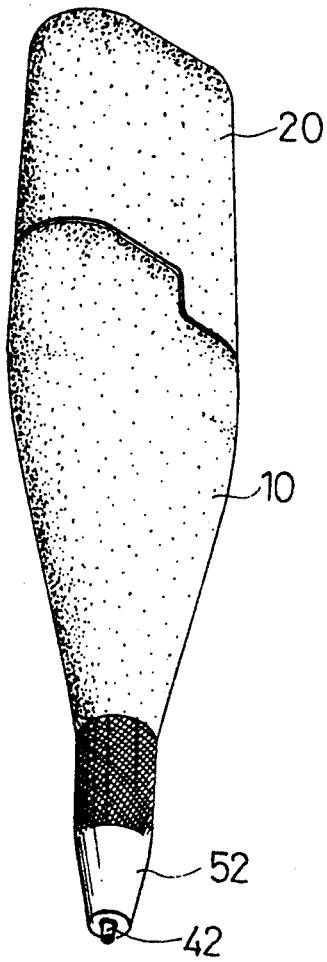
FIG. 3 is a diagram showing the present vibrator tool with a battery box.
Figure 4:
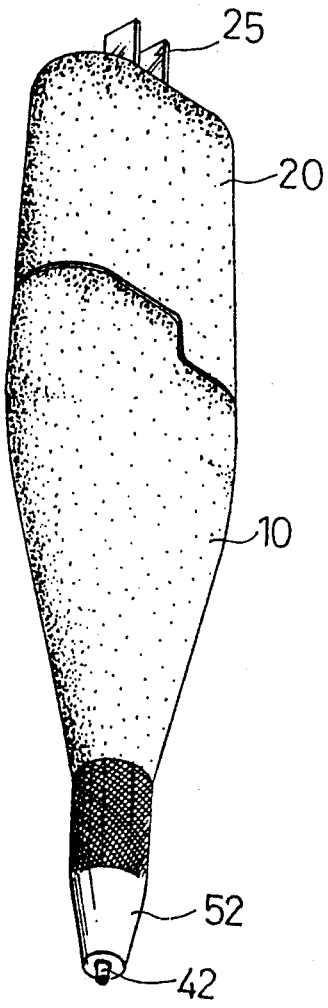
FIG. 4 is a diagram showing the present vibrator tool with a plug for recharging purpose.
Figure 5:
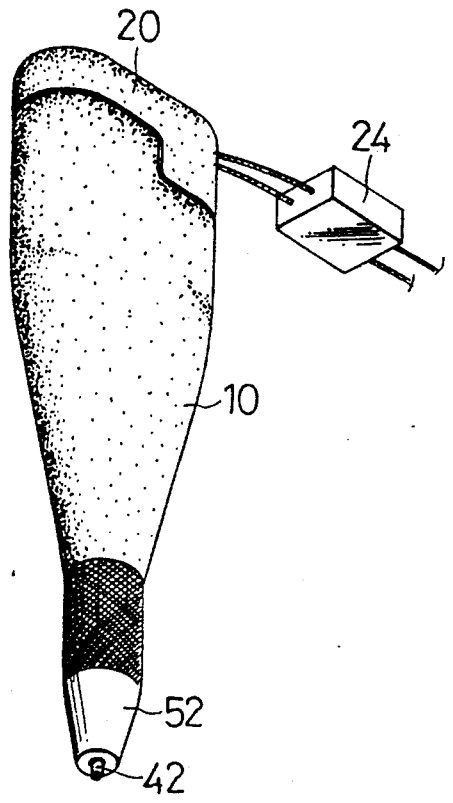
FIG. 5 is a diagram showing the present vibrator tool equipped with an adaptor.

To the end of the handle case 10 is attached a power box 20 which can be made in 3 forms. The first type is designed to have a container 21 for receiving common or rechargeable batteries 22 . The second type of the power box 20 is provided with a plug 25 which can be plugged to a socket of an electric power source to charge the rechargeable batteries disposed the containter 21. The third type of the power box 20 is connected to an adaptor 24 and is only provided with a pair conductive metal pieces 23 at the bottom thereof. As shown in FIGS. 3, 4, 5, the power box 20 of the above three types can be attached to the end of the handle case 10 alternatively in consideration of the availability of the suitable electric power source. Thereby the present vibrator tool can selectively employ the most handy electric power sources.

I claim:

1. An improved electric vibrator tool, comprising:

a handle case;

a power box attached to the end of said handle case;

a driving means disposed inside said handle case and having a driving shaft;

a driving rod having a slot disposed at one end thereof with said driving shaft of said driving means disposed through said slot; and a recess being defined in association with said slot and having a length equal to the diameter of an eccentric disc so that said disc can be fit inside said recess;

an inner sleeve having a horizontally disposed eccentric disc attached at one end thereof and being disposed inside of said handle case with part thereof protruding the front opening of said handle case;

an outer sleeve having one end thereof engaged with the protruding end of said inner sleeve;

a switch means disposed in abutment with said eccentric disc attached at the end of said inner sleeve and being actuated by rotation of said outer sleeve;

said eccentric disc disposed in said recess being connected with said driving shaft of said driving means led through said slot;

said power box having a container for receiving batteries;

a clamping means secured to the end of said driving rod opposed to the end having said slot defined thereon and being led through said inner sleeve and protruding said outer sleeve.

2. An improved electric vibrator tool as claimed in claim 1 wherein said power box is provided with a plug means at the end thereof for charging the rechargeable batteries disposed therein.

3. An improved elctric vibrator tool as claimed in claim 1 wherein said power box is provided with a pair of electrically conductive pieces at the bottom thereof with an adaptor connected thereto so as to permit said vibrator tool to use A.C. power source.

* * * * *